US005829724A

United States Patent [19]

Duncan

[11] Patent Number: 5,829,724

[45] Date of Patent: Nov. 3, 1998

[54] ANTENNA-MOUNTING STRUCTURE

[75] Inventor: Charles M. Duncan, Frankfort, Ind.

[73] Assignee: ROHN Industries, Inc., Peoria, Ill.

[21] Appl. No.: 621,165

[22] Filed: Mar. 22, 1996

[51] Int. Cl.[6] ..... H01Q 1/22; E04H 12/18

[52] U.S. Cl. ..... 248/237; 343/880; 248/516

[58] Field of Search ..... 248/237, 205.1, 248/48.1, 148, 536; 182/45; 343/880, 881, 882, 878

[56] References Cited

U.S. PATENT DOCUMENTS

| | | | |
|---|---|---|---|
| 2,584,713 | 2/1952 | Kanaval | 248/237 X |
| 3,509,578 | 4/1970 | Cribb | 343/873 |
| 4,251,819 | 2/1981 | Vickland | 343/882 |
| 4,379,297 | 4/1983 | Chevallier | 343/882 |
| 4,510,502 | 4/1985 | Hovland et al. | 343/880 |
| 4,612,552 | 9/1986 | Hovland et al. | 343/880 |
| 4,656,486 | 4/1987 | Turner | 343/882 |
| 4,723,128 | 2/1988 | Gasque, Jr. | 343/880 |
| 4,783,662 | 11/1988 | Wirth, Jr. et al. | 343/757 |
| 4,799,624 | 1/1989 | Wright | 343/880 X |
| 4,868,578 | 9/1989 | Bruinsma et al. | 343/882 |
| 5,184,145 | 2/1993 | Devillers et al. | 343/840 |
| 5,363,116 | 11/1994 | Allen | 343/881 |

*Primary Examiner*—Alvin C. Chin-Shue
*Assistant Examiner*—Long Dinh Phan
*Attorney, Agent, or Firm*—Dressler, Rockey, Milnamow & Katz, Ltd.

[57] ABSTRACT

An antenna-mounting structure is disclosed for mounting an antenna to a vertical wall or on a sloped, peaked, or horizontal roof. A primary strut, which is tubular, has a straight, upper portion, a straight, intermediate portion, and a straight, lower portion. The upper portion has an outer, cylindrical surface, circular in cross-section, and is bent at an upper juncture between the upper and intermediate portions and at a lower juncture between the intermediate and lower portions. The upper and intermediate portions generally define an obtuse angle and the intermediate and lower portions generally define an acute angle. A secondary strut has a proximal end and a distal end is clamped at the proximal end of the secondary strut to the outer, cylindrical surface of the upper portion of the primary strut, above the upper juncture, so that the secondary strut can be adjustably oriented to project in any direction from the upper portion of the primary strut, and so that the secondary strut can be pivotally adjusted to any angle within a range so that the distal end can be higher than, level with, or lower than the proximal end.

7 Claims, 2 Drawing Sheets

ANTENNA-MOUNTING STRUCTURE

TECHNICAL FIELD OF THE INVENTION

This invention pertains to an antenna-mounting structure, which is useful for mounting an antenna to a vertical wall or on a sloped, peaked, or horizontal roof. The antenna may be a small, dish-shaped antenna for receiving television signals broadcast by a satellite in a geosynchronous orbit.

BACKGROUND OF THE INVENTION

In an emerging technology, which is known as direct satellite broadcasting, small, dish-shaped antennas are used to receive television signals, which are broadcast by satellites in geosynchronous orbits.

Various mounts for mounting small, dish-shaped antennas or other antennas on horizontal surfaces or on sloped roofs are exemplified in prior patents including Hovland et al. U.S. Pat. No. 4,510,502 and U.S. Pat. No. 4,612,552, Turner U.S. Pat. No. 4,656,486, Gasque, Jr., U.S. Pat. No. 4,723,128, and Wirth, Jr., et al. U.S. Pat. No. 4,783,662.

A need has arisen, to which this invention is addressed, for an antenna-mounting structure that can be readily adapted for mounting an antenna, such as a small, dish-shaped antenna, to a vertical wall or on a roof, which may be sloped, peaked, or horizontal.

SUMMARY OF THE INVENTION

This invention provides an antenna-mounting structure comprising a primary strut, a secondary strut, and a connecting means, in a novel combination enabling the antenna-mounting structure to be alternatively used for mounting an antenna to a vertical wall or on a sloped, peaked, or horizontal roof.

The primary strut has an upper portion, an intermediate portion, and a lower portion, along with an upper juncture between the upper and intermediate portions and a lower juncture between the intermediate and lower portions. The upper juncture is configured so that the upper and intermediate portions generally define an obtuse angle. The lower juncture is configured so that the intermediate and lower portions generally define an acute angle.

The secondary strut has a proximal end and a distal end. The connecting means is used for connecting the proximal end of the secondary strut to the upper portion of the primary strut, above the upper juncture, so that the secondary strut can be adjustably oriented to project in any of plural directions from the upper portion of the primary strut, at any angle within a range so that the distal end can be higher than, level with, or lower than the proximal end.

Preferably, the upper portion of the primary strut has an outer, cylindrical surface, which is circular in cross-section, and the connecting means comprises means for clamping the proximal end of the secondary strut to the outer, cylindrical surface and for enabling the secondary strut to be pivotally adjusted to any angle within the range. Preferably, moreover, the primary strut is tubular and is bent at the upper and lower junctures.

Preferably, if the upper and lower portions of the primary strut are straight and if each of those portions defines an imaginary centerline, the imaginary centerlines defined by those portions are not coplanar. Moreover, if the intermediate portion thereof is straight, the imaginary centerlines defined by the upper and intermediate portions thereof generally define the obtuse angle noted above and the imaginary centerlines defined by the intermediate and lower portions thereof generally define the acute angle noted above.

These and other objects, features, and advantages of this invention are evident from the following description of a preferred embodiment of this invention, with reference to the accompanying drawings.

DETAILED DESCRIPTION OF THE PREFERRED EMBODIMENT

Figure 1:
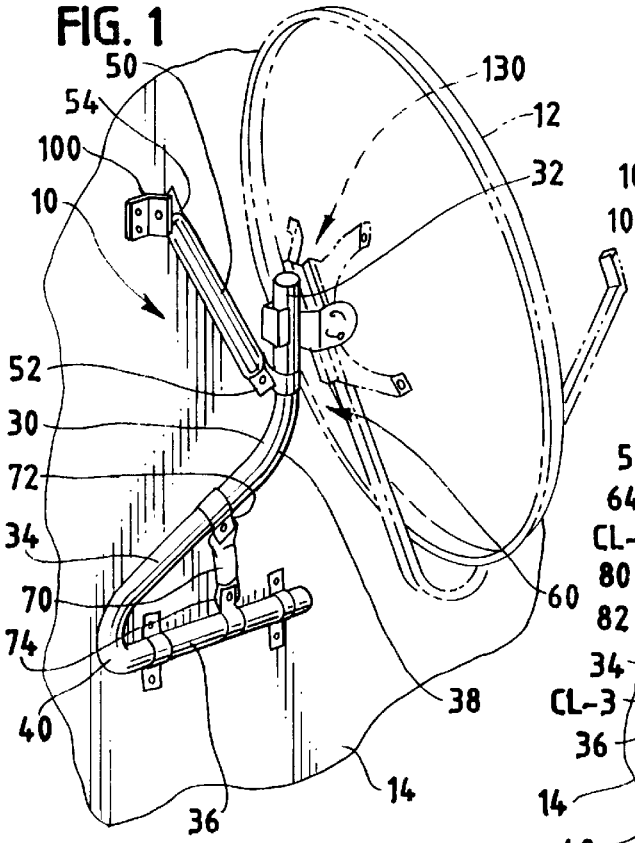
FIG. 1 is a perspective view of an antenna-mounting structure, as used to mount a small, dish-shaped antenna to a vertical wall, which is shown fragmentarily. The antenna is shown in phantom lines.
Figure 2:
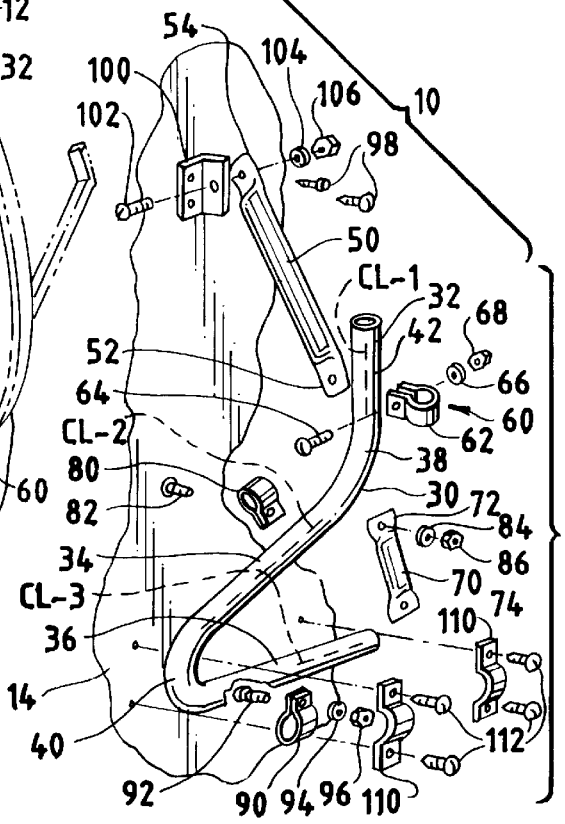
FIG. 2 is an exploded, perspective view of the antenna-mounting structure, as shown in FIG. 1 but without the antenna.
Figure 3:
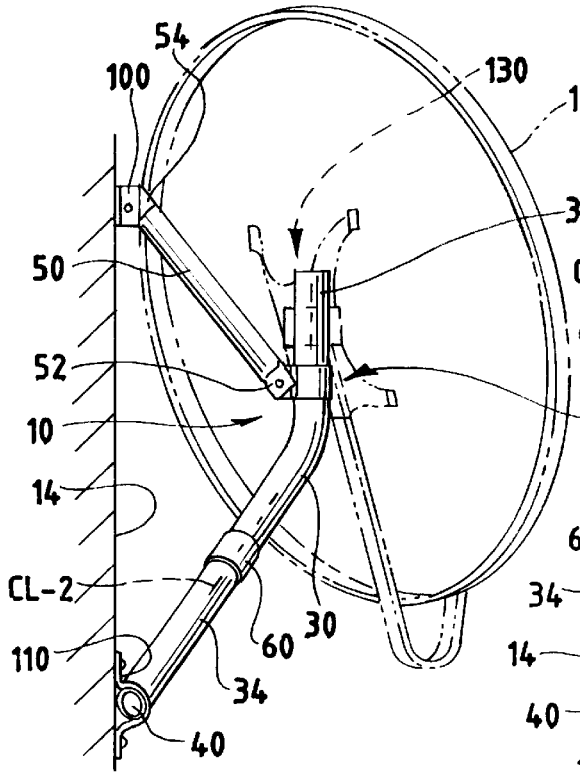
FIG. 3 is a side elevation of the antenna-mounting structure, as shown in FIG. 1 with the antenna shown similarly in phantom lines.
Figure 4:
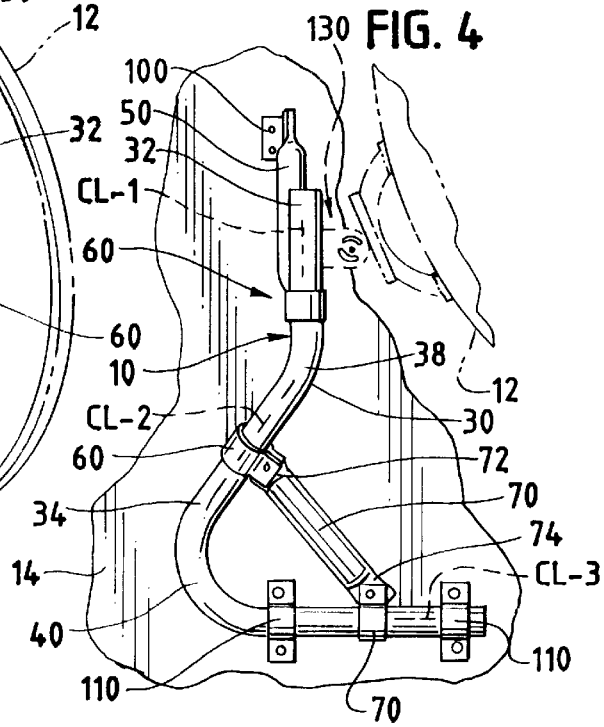
FIG. 4 is a front elevation of the antenna-mounting structure, as shown in FIG. 1 with the antenna shown fragmentarily in phantom lines.
Figure 5:
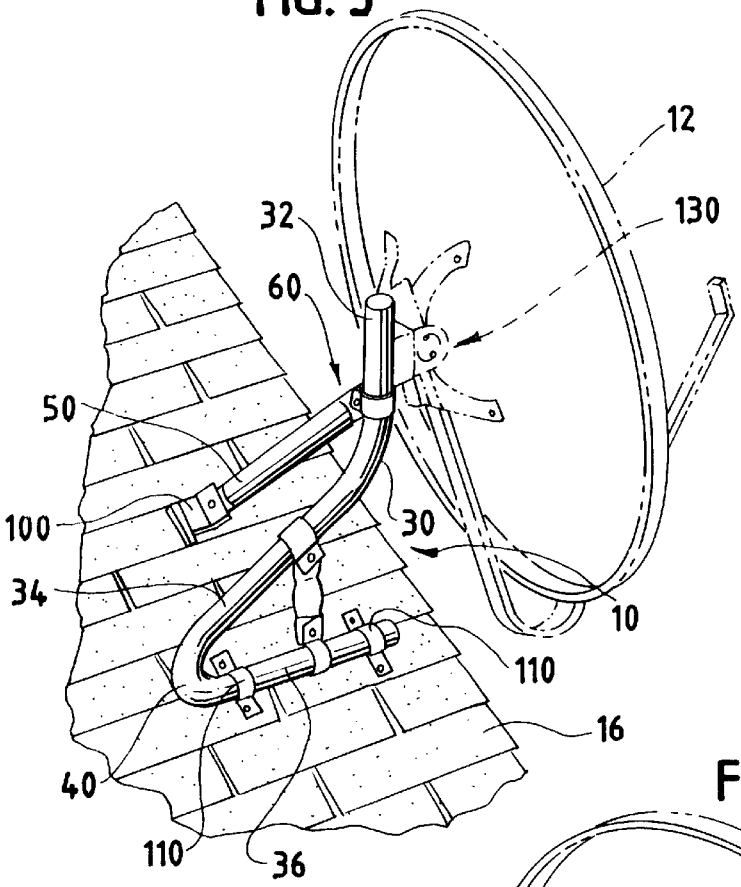
FIG. 5 is a perspective view of the antenna-mounting structure, as used to mount the same antenna on a sloped roof, which is shown fragmentarily. The antenna is shown again in phantom lines.
Figure 6:
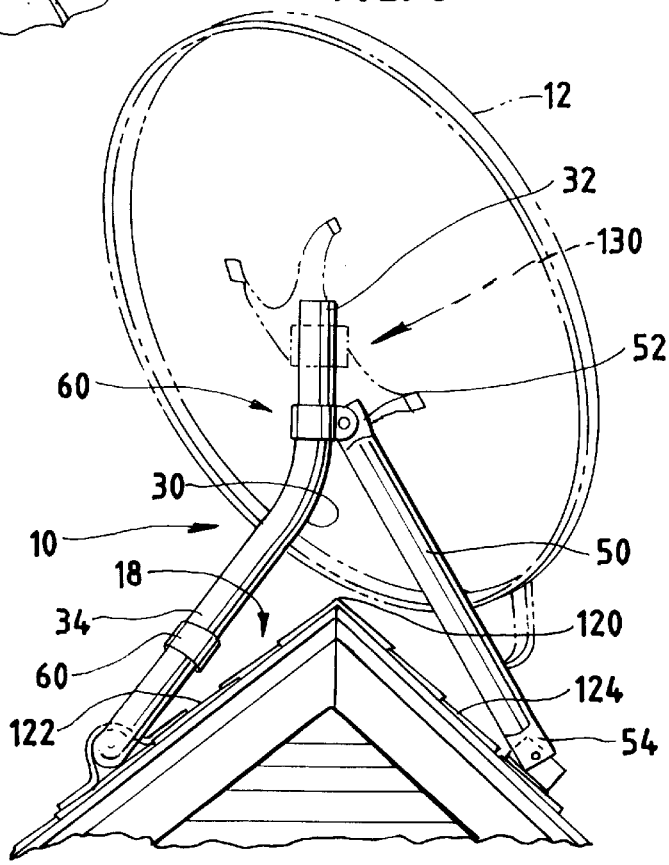
FIG. 6 is a perspective view of the antenna-mounting structure, as used to mount the same antenna on a peaked roof, which is shown fragmentarily. The antenna is shown again in phantom lines.

As shown in the drawings, an antenna-mounting structure 10 constituting a preferred embodiment of this invention can be readily adapted for mounting a small, dish-shaped antenna 12 or another antenna (not shown) of a similar or dissimilar type alternatively to a vertical wall 14, as shown in FIGS. 1 through 4, on a sloped roof 16, as shown in FIG. 5, on a peaked roof 18, as shown in FIG. 6, or on a horizontal roof (not shown).

The antenna-mounting structure 10 comprises a tubular, primary strut 30, which has a straight, upper portion 32 defining an imaginary centerline CL-1, a straight, intermediate portion 34 defining an imaginary centerline CL-2, and a straight, lower portion 36 defining an imaginary centerline CL-3. The primary strut 30 is bent so as to form an upper juncture 38 between the upper portion 32 and the intermediate portion 34 and a lower juncture 40 between the intermediate portion 34 and the lower portion 36. Being tubular, the upper portion 32 has a cylindrical, outer surface 42, which is circular in cross-section.

The upper juncture 38 is configured so that the imaginary centerline CL-1 defined by the upper portion 32 and the imaginary centerline CL-2 defined by the intermediate portion 34 intersect and define an obtuse angle at their intersection, whereby the upper portion 32 and the intermediate portion 34 generally define the obtuse angle. The lower juncture 40 is configured so that the imaginary centerline CL-2 defined by the intermediate portion 34 and the imaginary centerline CL-3 defined by the lower portion 36 intersect and define an acute angle at their intersection, whereby the intermediate portion 34 and the lower portion 36 generally define the acute angle.

Moreover, the upper juncture 38 and the lower juncture 40 are configured so that the imaginary centerline CL-1 defined by the upper portion 32 and the imaginary centerline CL-3 defined by the lower portion 36 are not coplanar. Rather, any imaginary plane through the imaginary centerline CL-3 defined by the lower portion 36 either intersects or is parallel to the imaginary centerline CL-1 defined by the upper portion 32. Therefore, when the antenna-mounting structure is secured to the vertical wall 14, as shown in FIGS. 1 through 4, or on the sloped roof 16, as shown in FIG. 5, so that the lower portion 36 extends horizontally and so that the upper portion 32 extends upwardly and vertically, the upper portion 32 is spaced from the vertical wall 14. Thus, the antenna 12 can be rotatably adjusted on the upper portion 32, through a useful range of rotated positions, without interference with the vertical wall 14 or with the sloped roof 16.

The antenna-mounting structure 10 comprises a tubular, secondary strut 50, which has a flattened, proximal end 52 and a flattened, distal end 54. As means 60 for connecting the proximal end 52 to the outer surface 42 of the upper portion 32 of the primary strut 30, the antenna-mounting structure 10 further comprises a strap 62 fitting around the upper portion 32, a bolt 64 passing through suitable holes in the strap 62 and in the proximal end 52, a washer 66 fitted onto the bolt 64, and a nut 68 threaded onto the bolt 64. Advantageously, the connecting means 60 not only enables the secondary strut 50 to be adjustably oriented to project in any direction from the upper portion 32 of the primary strut 30 but also enables the secondary strut 50 to be pivotally adjusted to any angle within a useful range so that the distal end 54 can be higher than the proximal end 52, as shown in FIGS. 1 through 4, level with the proximal end 52, or lower than the proximal end 52, as shown in FIG. 5 and as shown in FIG. 6.

The antenna-mounting structure 10 comprises a tubular, tertiary strut 70, which has a flattened, upper end 72 and a flattened, lower end 74, and which is used to brace the primary strut 30. The upper end 72 is connected to the intermediate portion 34 of the primary strut 30 by a strap 80 fitting around the intermediater portion 34, a bolt 82 passing through suitable holes in the strap 80 and in the upper end 72, a washer 84 fitted onto the bolt 82, and a nut 86 threaded onto the bolt 82. The lower end 74 is connected to the lower portion 36 of the primary strut 30 by a strap 90 fitting around the lower portion 36, a bolt 92 passing through suitable holes in the strap 90 and in the lower end 74, a washer 94 fitted onto the bolt 92, and a nut 96 threaded onto the bolt 92.

A bracket 100 is secured to the distal end 54 of the secondary strut 50 via bolt 102 passing through suitable holes in the bracket 100 and in the distal end 54, a washer 104 fitting over the bolt 102, and a nut 106 threaded onto the bolt 102. Screws or other fasteners (not shown) are used to secure the bracket 100 to the vertical wall 14, as shown in FIGS. 1 through 4, to the sloped roof 18, as shown in FIG. 5, on the peaked roof 18, as shown in FIG. 6, or on a horizontal roof (not shown). The bolt 102 enables the distal end 54 and the bracket 100 to be pivotally adjusted within a useful range so that the distal end 54 can be higher than, level with, or lower than the proximal end 52. Spaced straps 110 and screws 112 or other fasteners (not shown) are used to secure the lower portion 36 of the primary strut 30 to the vertical wall 14, as shown in FIGS. 1 through 4, to the sloped roof 16, as shown in FIG. 5, on the peaked roof 18, as shown in FIG. 6, or on a horizontal roof (not shown).

Preferably, when the antenna-mounting structure 10 is secured to the vertical wall 14, the secondary strut 50 is adjusted via the connecting means 60 so as to project toward the vertical wall 14 and upwardly, as shown in FIGS. 1 through 4. In an alternative arrangement (not shown) which is not preferred, the secondary strut 50 is adjusted via the connecting means 60 so as to project toward the vertical wall 14 and downwardly.

When the antenna-mounting structure 10 is secured to the sloped roof 16, the secondary strut 50 is adjusted via the connecting means 60 so as to project toward the sloped roof 16 and downwardly, as shown in FIG. 5. The secondary strut 50 is adjustable via the connecting means 60 to accommodate a wide range of possible slopes for the sloped roof 16.

When the antenna-mounting structure 10 is secured on the peaked roof 18, which has a horizontally extending peak 120 defined by two sloped surfaces 122, 124, the lower portion 36 of the primary strut 30 is secured to one such surface 122, the secondary strut 50 is adjusted via the connecting means 60 so as to project downwardly and toward the other surface 124, and the distal end 54 of the secondary strut 50 is secured to the latter surface 124, as shown in FIG. 6. The antenna-mounting structure 10 can be similarly secured to a horizontal roof (not shown) if the secondary strut 50 is adjusted similarly.

Whether the antenna-mounting structure 10 is secured to the vertical wall 14, as shown in FIGS. 1 through 4, on the sloped roof 16, as shown in FIG. 5, on the peaked roof 18, as shown in FIG. 6, or on a horizontal roof (not shown) the antenna 12 is mounted to the upper portion 32 of the primary strut 30, via a suitable mounting means 130 outside the scope of this invention.

Various modifications may be made in the preferred embodiment without departing from the scope and spirit of this invention.

I claim:

1. An antenna-mounting structure comprising a primary strut and a secondary strut, the primary strut having an upper portion, an intermediate portion, and a lower portion, the primary strut having an upper juncture where the upper and intermediate portions are joined and a lower juncture where the intermediate and lower portions are joined, the upper juncture being configured so that the upper and intermediate portions generally define an obtuse angle where the upper and intermediate portions are joined at the upper juncture and the lower juncture being configured so that the intermediate and lower portions generally define an acute angle where the intermediate and lower portions are joined at the lower juncture, the secondary strut having a proximal end and a distal end, and the antenna-mounting structure further comprising means for connecting the proximal end of the secondary strut to the upper portion of the primary strut, above the upper juncture, so that the secondary strut can be adjustable oriented to project in any of plural directions from the upper portion of the primary strut, at any angle within a range so that the distal end can be higher than, level with, or lower than the proximal end, wherein the upper portion of the primary strut has an outer, cylindrical surface, which is circular in cross-section, and wherein the connecting means comprises means for clamping the proximal end of the secondary strut to the outer, cylindrical surface and for enabling the secondary strut to be pivotally adjusted to any angle within the range, and wherein the primary strut is tubular and is bent at the upper and lower junctures.

2. The antenna-mounting structure of claim 1 wherein the upper and lower portions of the primary antenna-mounting structure are straight.

3. The antenna-mounting structure of claim 2 wherein the upper portion of the primary strut defines an imaginary centerline, wherein the lower portion of the primary strut defines an imaginary centerline, and wherein the imaginary centerlines defined by the upper and lower portions of the primary strut are not coplanar.

4. The antenna-mounting structure of claim 1 wherein the upper, intermediate, and lower portions of the primary strut are straight.

5. The antenna-mounting structure of claim 6 wherein the upper portion of the primary strut defines an imaginary centerline, wherein the intermediate portion of the primary strut defines an imaginary centerline, wherein the lower portion of the primary strut defines an imaginary centerline, wherein the imaginary centerlines defined by the upper and intermediate portions thereof generally define the obtuse angle, wherein the imaginary centerlines defined by the intermediate and lower portions thereof generally define the acute angle, and wherein the imaginary centerlines defined by the upper and lower portions of the primary strut are not coplanar.

6. An antenna-mounting structure comprising a primary strut, a secondary strut, and a tertiary strut, the primary strut being tubular and having a straight, upper portion defining an imaginary centerline, a straight, intermediate portion defining an imaginary centerline, and a straight, lower portion defining an imaginary centerline, not coplanar with the imaginary centerline defined by the upper portion, the upper portion having an outer, cylindrical surface, circular in cross-section, the primary strut being bent at an upper juncture where the upper and intermediate portions are joined and at a lower juncture where the intermediate and lower portions are joined, the upper juncture being configured so that the imaginary centerlines defined by the upper and intermediate portions generally define an obtuse angle where the upper and intermediate portions are joined at the upper juncture and the lower juncture being configured so that the imaginary centerlines defined by the intermediate and lower portions generally define an acute angle where the intermediate and lower portions are joined at the lower juncture, the secondary strut having a proximal end and a distal end, and the antenna-mounting structure further comprising means for clamping the proximal end of the secondary strut to the outer, cylindrical surface of the upper portion of the primary strut, above the upper juncture, so that the secondary strut can be adjustably oriented to project in any direction from the upper portion of the primary strut, and so that the secondary strut can be pivotally adjusted to any angle within a range so that the distal end can be higher than, level with, or lower than the proximal end, the tertiary strut being spaced from the lower juncture and being connected to the intermediate and lower portions of the primary strut so as to brace the intermediate and lower portions of the primary strut.

7. An antenna-mounting structure comprising a primary strut and a secondary strut, the primary strut having an upper portion, an intermediate portion, and a lower portion, the primary strut having an upper juncture where the upper and intermediate portions are joined and a lower juncture where the intermediate and lower portions are joined, the upper juncture being configured so that the upper and intermediate portions generally define an obtuse angle where the upper and intermediate portions are joined at the upper juncture and the lower juncture being configured so that the intermediate and lower portions generally define an acute angle where the intermediate and lower portions are joined at the lower juncture, the secondary strut having a proximal end and a distal end, and the antenna-mounting structure further comprising means for connecting the proximal end of the secondary strut to the upper portion of the primary strut, above the upper juncture, so that the secondary strut can be adjustably oriented to project in any of plural directions from the upper portion of the primary strut, at any angle within a range so that the distal end can be higher than, level with, or lower than the proximal end, and wherein the primary strut is tubular and is bent at the upper and lower junctures.

* * * * *